US005224610A

United States Patent [19]

Veazey

[11] Patent Number: 5,224,610

[45] Date of Patent: Jul. 6, 1993

[54] THREE DIMENSIONAL WALL MOUNTED STRIPING SYSTEM

[76] Inventor: Robert M. Veazey, 1818 S. Meridian, Wichita, Kans. 67213

[21] Appl. No.: 738,881

[22] Filed: Aug. 1, 1991

[51] Int. Cl.[5] ..... A47F 5/08

[52] U.S. Cl. ..... 211/87; 40/618; 211/162

[58] Field of Search ..... 211/87, 94, 94.5, 162; 52/242, 287, 290, 551, 718.1; 40/611, 618, 617; 248/222.2, 223.3, 222.1, 339, 340, 489

[56] References Cited

U.S. PATENT DOCUMENTS

| | | | |
|---|---|---|---|
| 2,880,537 | 4/1959 | Cygan | 40/618 X |
| 3,224,715 | 12/1965 | Maggiore | 248/339 |
| 3,270,474 | 9/1966 | Driggers | 52/718.1 X |
| 3,321,878 | 5/1967 | Brown et al. | 52/287 X |
| 3,685,186 | 8/1972 | Goodman | 40/618 |
| 4,059,914 | 11/1977 | Dobson | 40/611 |
| 4,311,295 | 1/1982 | Jamar, Jr. | 248/222.2 X |
| 4,621,471 | 11/1986 | Kuhr et al. | 52/718.1 X |
| 4,691,392 | 9/1987 | Whitney | 52/718.1 X |
| 4,753,026 | 6/1988 | Woodman et al. | 40/584 |

*Primary Examiner*—Alvin C. Chin-Shue
*Assistant Examiner*—Korie Chan
*Attorney, Agent, or Firm*—Edwin H. Crabtree; Donald W. Margolis

[57] ABSTRACT

A three dimensional wall mounted striping system for displaying a business or a company logo, name, trade dress, colors, announcements and other types of display graphics. The system includes a wall bracket for mounting on a wall. The wall bracket has a first bracket hanger arm and a first bracket snap arm. The bracket also has a plurality of index grooves along a length of the bracket for receiving fasteners therethrough and securing the bracket to the wall. The system further includes an elongated first profile member having a flat facing with an first profile hanger arm along a length of a top of the facing and a first profile snap arm along the length of a bottom of the facing. When the profile hanger arm of the profile member is hung on top of the bracket hanger arm of the wall bracket, the profile member is suspended therefrom. Further when the profile snap arm is pressed into releasable engagement with the bracket snap arm, the profile member is securely held on the wall bracket. The profile hanger arm also includes a groove therein and along the length of the facing for receiving a hanger bracket attached to the back of a graphic display board for suspending the display board thereon. The wall bracket can also include a plurality of upper bracket hanger arms and lower bracket snap arms for receiving more than one profile members and holding the profile members parallel and in a spaced relationship to each other while giving an overall attractive three dimensional look with the profile members having different colors as desired.

11 Claims, 2 Drawing Sheets

THREE DIMENSIONAL WALL MOUNTED STRIPING SYSTEM

BACKGROUND OF THE INVENTION

1. Field of the Invention

This invention relates to a business and a company display graphics and more particularly but not by way of limitation to a three dimensional wall mounted striping system for displaying a business and company name, logo, colors, trade dress, advertizing, announcements, and various other types of display graphics used by businesses dealing with customers and clients.

2. Discussion of Prior Art

Heretofore there have been a variety of different types of sign attachments, sign support brackets, advertising and merchandising display stands and the like. This prior art is shown is the following U.S. Patents. They are U.S. Pat. Nos. 4,951,906 to Morey; 4,709,891 to Barnett; 4,888,894 to Brown, Jr.; 4,798,013 to Sainato; 4,854,533 to Sainato; Des. 276,825 and Des. 277,196 to Eason. None of the above mentioned patents disclose the unique features and advantages of the subject striping system as disclosed herein.

SUMMARY OF THE INVENTION

In view of the foregoing, it is an object of the present invention to provide a three dimensional, snap together, striping system.

Another object of the invention is to provide a striping system that is attractive in appearance, rugged in construction, stream lined in design, can easily be installed by a single installer, and is removable and reusable.

A further object of the invention is the system can be used for displaying a business or a company logo, colors, name, trade dress, announcements, advertisements, and other types of display graphics.

Still another object of the system is to provide a light weight striping system that hides all mounting hardware, is prespaced for perfect alignment, may be cut to any length with staggered joints, and is economical when compared to other types of signs and graphic displays made of wood and similar materials.

Yet another object of the invention is the striping system is made of a strong rigid plastic, is color stable, can be cut to size without burred edges, and can come in variety of attractive color selections with a non-glare, matte finish surface.

Another object of the striping system, while described primarily for interior wall use, is the system can easily be adapted of a variety of surfaces for both interior and exterior use. Also the system is semi-rigid to accommodate wall surface irregularities and includes end caps and 90 degree bent profile members for outside and inside corners when needed.

A further object of the invention is the striping system includes a wall bracket which includes a plurality of hanger arms and snap arms for receiving more than one profile members of different colors in a parallel and spaced relationship to each other for giving an overall attractive three dimensional appearance.

The subject three dimensional wall mounted striping system for displaying various types of graphic design includes a wall bracket for mounting on a wall. The wall bracket includes an first bracket hanger arm and a first bracket snap arm. The wall bracket also includes a plurality of index grooves along a length of the bracket for receiving different types of fasteners such as screws, staples, nails and the like for securing the wall bracket to the wall. The system also includes an elongated first profile member having a flat facing with an first profile hanger arm along a length of a top of the facing and a first profile snap arm along the length of a bottom of the facing. When the first profile hanger arm of the profile member is hung on top of the first bracket hanger arm of the wall bracket, the profile member is suspended therefrom. Further when the first profile snap arm is pressed into releasable engagement with the first bracket snap arm, the profile member is securely held on the wall bracket. The first profile hanger arm also includes a groove therein and along the length of the facing for receiving a hanger bracket attached to the back of a graphic display board for displaying the board thereon. The wall bracket may also include a plurality of bracket hanger arms and bracket snap arms for receiving more than one profile members and holding the profile members parallel and in a spaced relationship to each other for giving an overall attractive three dimensional look with the profile members having different colors as desired.

These and other objects of the present invention will become apparent to those skilled in the art from the following detailed description, showing the contemplated novel construction, combination, and elements as herein described, and more particularly defined by the appended claims, it being understood that changes in the precise embodiments to the herein disclosed invention are meant to be included as coming within the scope of the claims, except insofar as they may be precluded by the prior art.

BRIEF DESCRIPTION OF THE DRAWINGS

The accompanying drawings illustrate complete preferred embodiments of the present invention according to the best modes presently devised for the practical application of the principles thereof, and in which.

DETAILED DESCRIPTION OF THE PREFERRED EMBODIMENT

Figure 1:
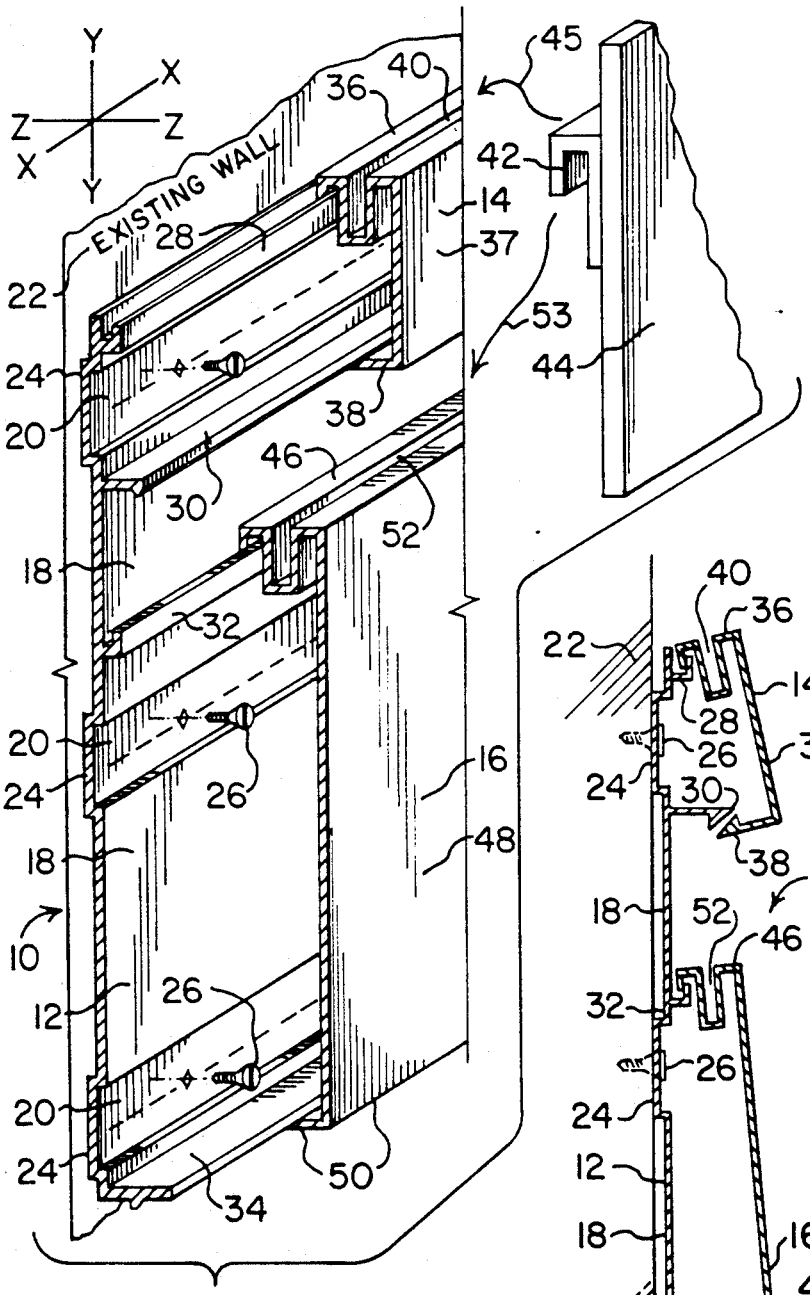
FIG. 1 is a perspective view of the striping system showing a portion of the wall bracket mounted on an existing wall with a portion of a first and a second profile member mounted thereon for receiving a graphic display board suspended therefrom.

Referring to FIG. 1 the subject three dimensional wall mounted striping system is shown having general reference numeral 10. Broadly the system 10 includes a wall bracket 12 and at least one or more profile members. In the drawings a first elongated profile member 14 and a wider second elongated profile member 16 are shown. It should be kept in mind that while the two profile members 14 and 16 are shown, the subject system 10 works equally well with a single profile member or more than two profile members without departing from the spirit and scope of the invention as described herein.

The wall bracket 12 includes a flat web 18 having a plurality of parallel spaced apart index grooves 20 along the length of the bracket 12 and set in from the web 18 so that the bracket 12 is offset from the front of an existing wall 22 except where a back 24 of the grooves 20 contacts the wall 22. The bracket 12 is secured to the wall using fasteners such as screws 26. While the screws 26 are shown, staples, nails, or any other type of fasteners can be used equally well. By running a horizontal chalk line on the wall 22 prior to attaching the bracket 12, the bracket 12 can be quickly and horizontally secured to the wall 22 with the profiles 14 and 16 automatically held in a parallel and horizontal position when secured to the bracket 12.

Also shown in FIG. 1 is a X axis and Y axis defining the plain of the wall 22 and a Z axis extending outwardly from the wall 22. Through the use of the index grooves 20 which move the bracket 12 outwardly from the wall 22, and the use of the outwardly extending profile members 14 and 16, the striping system 10 gives a pleasing three dimensional appearance unlike a two dimensional graphic display or design which is common in commercial establishments. The bracket 12 and the profile members 14 and 16 may be made of extruded plastic and the like and may come in different lengths, sizes, and colors.

The wall bracket 12 also includes a "L" shaped first bracket hanger arm 28 along the top and length of the wall bracket 12. Disposed below the hanger arm 28 and parallel thereto is a half arrow shaped first bracket snap arm 30. The arms 28 and 30 are used for securing the first profile member 14 to the bracket 12. Below the arms 28 and 30 and parallel thereto are a "L" shaped second bracket hanger arm 32 and a half arrow shaped second bracket snap arm 34. The arms 32 and 34 are used for securing the second profile member 16 to the wall bracket 12.

The first profile member 14 includes a first profile hanger arm 36 along the top and length of a flat facing 37 and a half arrow first profile snap arm 38 along the bottom of the facing 37. The hanger arm 36 includes an elongated groove 40 along its length for receiving a hanger bracket 42 mounted on the back of a graphic display board 44. The mounting of the hanger bracket 42 is depicted be arrow 45. The display board 44 can be used for advertising and the like. Only a portion of the hanger bracket 42 and display board 44 are shown in FIG. 1 and it can be appreciated that the display board 44 can be of various sizes when used with the subject invention.

The second profile member 16 is similar in structure to the first profile member 14, but in this example the second profile member is wider. Also while only a portion of the members 14 and 16 are shown, they may be of various lengths up to eight feet or greater depending on the size of the wall 22 and the size of the striping system 10 desired. Also the wall bracket 12 and the profile members 14 and 16 are made of vinyl plastic or a similar material and are colored to correspond with a company's colors, trade dress or to compliment an interior or exterior decor. The second profile member 16 also includes a second profile hanger arm 46 along the top and length of a flat facing 48 and a half arrow second profile snap arm 50 along the bottom and length of the flat facing 48. The hanger arm 46 also includes an elongated groove 52 for receiving the hanger bracket 42 of the graphic display board 44. The mounting of the hanger bracket 42 on the hanger arm 46 is depicted by arrow 53. This would occur should it be decided that the board 44 should be suspended from the second profile member 16 rather than the first profile member 14. Also it understandable that more than one graphic display boards 44 may be used with the striping system 10 and hung from the system's profile members. Also the hanger brackets 42 attached to the display boards 44 may be adjusted along the length of the elongated grooves 40 and 52 for proper placement of the display boards 44 on the striping system 10.

Figure 2:
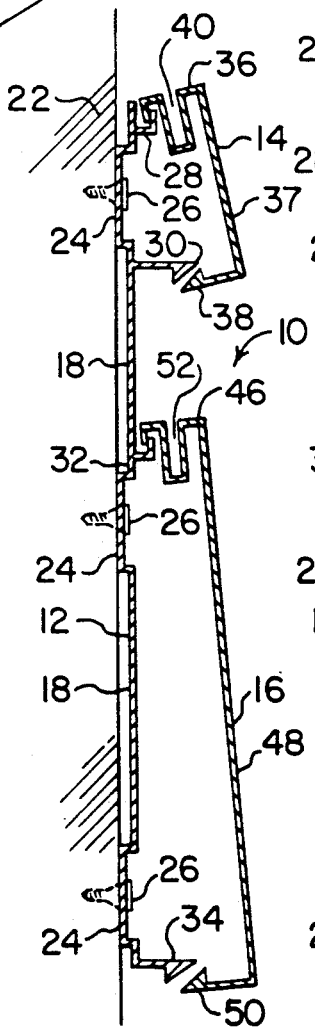
FIG. 2 is an end view of the striping system with the first and the second profile members suspended from bracket hanger arms of the wall bracket prior to being snapped into a secured position on the wall bracket.

In FIG. 1 and FIG. 2 an end view of the striping system 10 is shown. In these figures the wall bracket 12 has already been secured to the existing wall 22 using the screws 26 received through a portion of the index grooves 20. In FIG. 1 the first profile hanger arm 36 of the member 14 has been hung on the first bracket hanger arm 28 and the second profile hanger arm 46 of the member 16 has been hung on the second bracket hanger arm 32 of the wall bracket 12. It should be noted that while the profile members 14 and 16 are properly aligned on the wall bracket 12 and parallel to each other, the members 14 and 16 have not been snapped securely in place on the wall bracket 12.

In FIG. 2 the first profile snap arm 38 has been pressed to the left toward the wall 22 and has engaged and passed over the top of the first bracket snap arm 30 thereby securing the first profile member 14 to the wall bracket 12. Likewise the second profile snap arm 50 has also been pressed to the left toward the wall 22 and has engaged and passed over the top of the second bracket snap arm 34 thereby securing the second profile member 16 to the wall bracket 12. The profile members 14 and 16 are held firmly on the wall bracket 12 until it is desired to remove the striping system 10 and at that time the snap arm are disengaged from each other and the wall bracket 12 removed from the wall 22. The system 10 can than be moved to a different location and reused.

Figure 4:
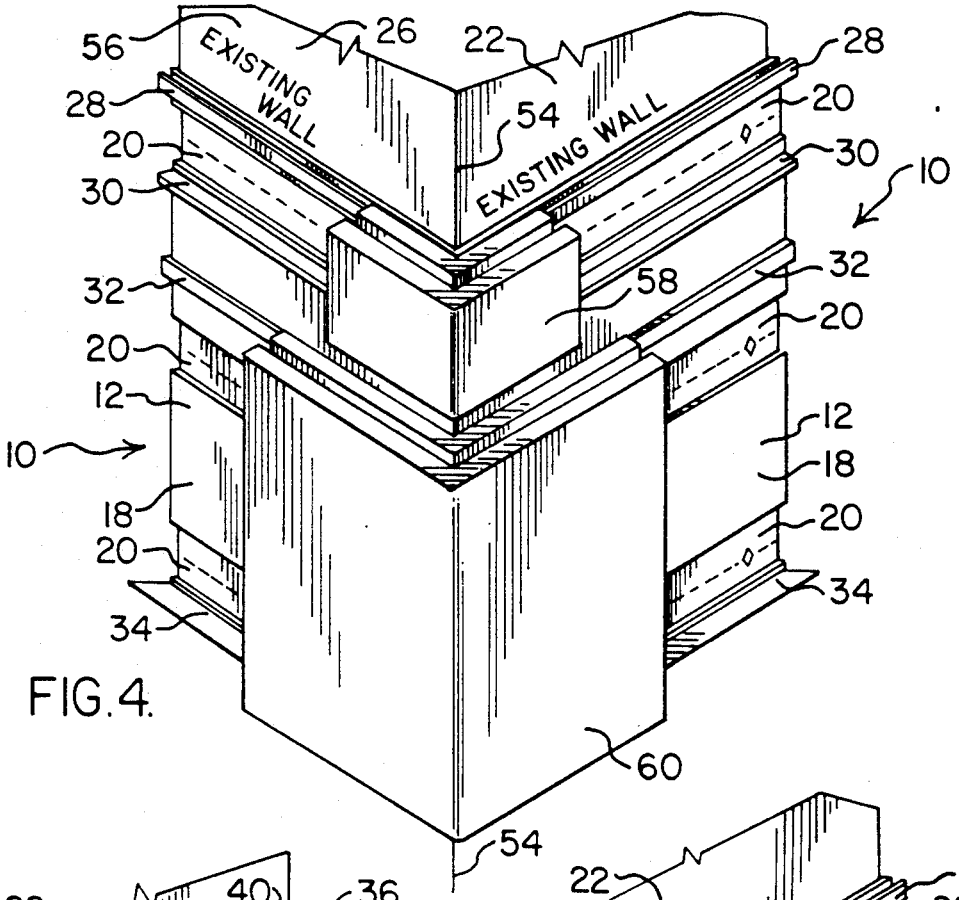
FIG. 4 is a perspective view of a pair of outside 90 degree corner members attached to a pair of wall brackets joined together at a corner of two walls.

In FIG. 4 the striping system 10 is shown mounted on an outside corner 54 where the existing wall 22 meets another wall 56. In this illustration, a section of the first profile member 14 has been bent 90 degrees forming a 90 degree outside corner profile member 58 for receipt on two intersecting wall brackets 12 attached to the walls 22 and 56. Also in this drawing the second profile member 16 has been bent 90 degrees to form another 90 degree outside corner profile member 60. This profile member 60 is also secured to the two intersecting wall brackets 12 attached to the walls 22 and 56. From viewing the two corner profile members 58 and 60, it can be seen that they are cut to different lengths so that the vertical cut or seam is staggered when these profile members engaged the ends of adjacent profile members 14 and 16 as shown in FIG. 1 for a more pleasing appearance. While inside corner profile members are not shown in the drawings of the striping system 10, it can be appreciated the these profile members would be substantially the same as the outside corner members 58 and 60, but bent in an opposite direction and at a 90 degree angle.

Figure 3:
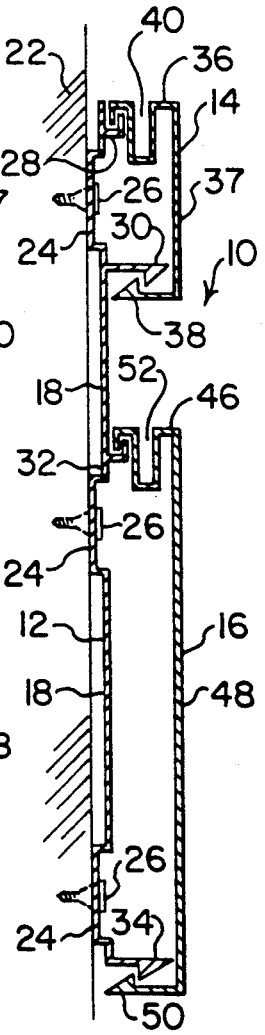
FIG. 3 is the same end view of the striping system as shown in FIG. 2 but with profile snap arms of the first and second profile members snapped into place and engaging bracket snap arms of the wall bracket and securing the first and second profile members on the wall bracket.
Figure 5:
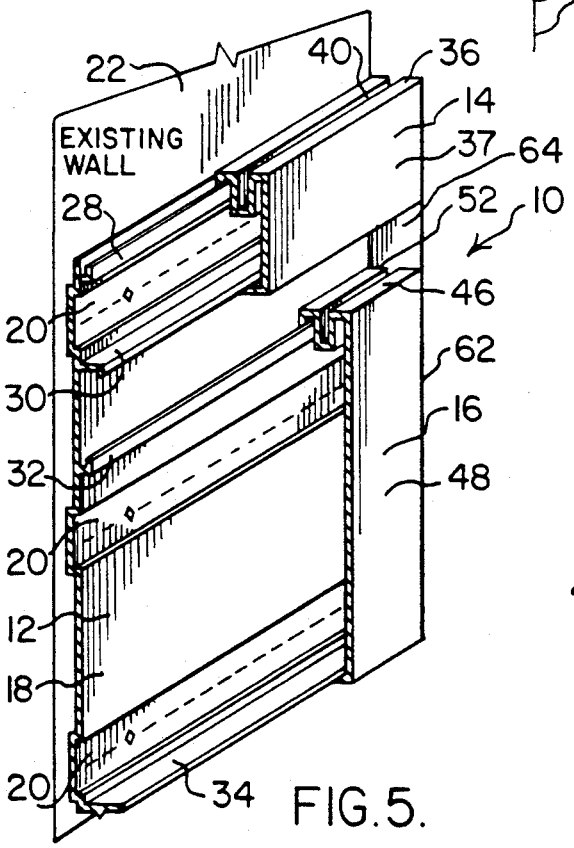
FIG. 5 and FIG. 6 are perspective views of a right end cap and a left end cap used for covering up opposite ends of the striping system when it is desired to enclose the ends of the wall bracket and profile members and sufficient room is provided.
Figure 6:
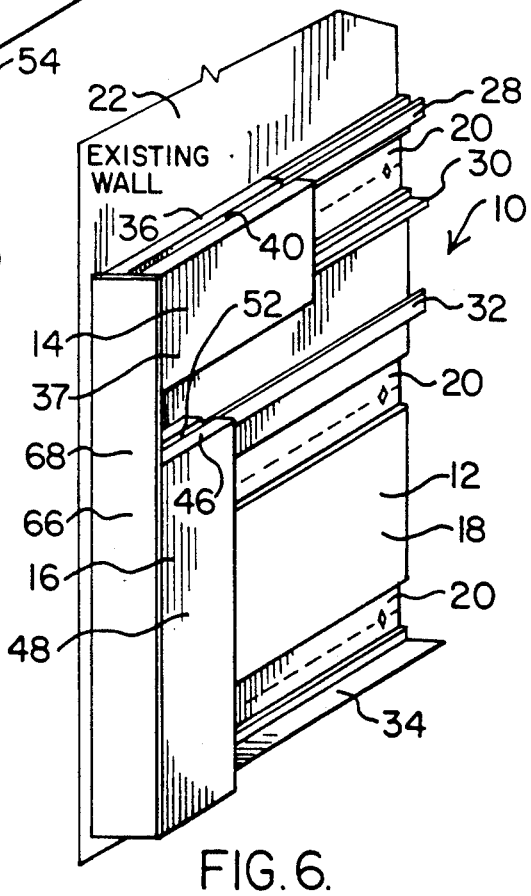

In FIG. 5 the striping system 10 is shown with a right end cap 62 having a face plate 64 attached to short sections of the profile members 14 and 16. The profile members 14 and 16 are cut to different lengths to stagger the vertical cut or seam for a more pleasing appearance when installed. In FIG. 6 the striping system 10 is shown with a left end cap 66 having a face plate 68 attached to short sections of the profile members 14 and 16. The end caps 62 and 66 are used with the striping system 10 when there is sufficient room at opposite ends of the system when installed and when the caps will add to the overall appearance of the striping system 10. The end caps 62 and 66 are attached to the wall bracket 12 in the same manner as the profile members 14 and 16 as discussed in the description of FIG. 3.

While the invention has been particularly shown, described and illustrated in detail with reference to the preferred embodiments and modifications thereof, it should be understood by those skilled in the art that the foregoing and other modifications are exemplary only, and that equivalent changes in form and detail may be made therein without departing from the true spirit and scope of the invention as claimed, except as precluded by the prior art.

The embodiments of the invention for which an exclusive privilege and property right is claimed are defined as follows:

1. A three dimensional striping system for mounting on a wall and displaying a graphic display board with hanger bracket attached thereto, the system comprising:

a wall bracket having a first bracket hanger arm extending outwardly therefrom and along the length of said wall bracket and a first bracket snap arm extending outwardly therefrom and along the length of said wall bracket, said first bracket snap arm disposed below said first bracket hanger arm; and a first profile member having a first profile hanger arm extending outwardly therefrom and along the length of said first profile member and a first profile snap arm extending outwardly therefrom and along the length of said first profile member, said first profile snap arm disposed below said first profile hanger arm, whereby, when said first profile hanger arm is suspended on said first bracket hanger arm and said first profile snap arm is releasably engaged to said first bracket snap arm, said first profile member is held firmly in place on said wall bracket providing a pleasing three dimensional appearance, said first profile hanger arm having a top surface with a groove therein and extending downwardly from said top surface, said groove extending along a length of said top surface of said first profile hanger arm, said groove adapted for slidable receipt of the hanger bracket of the graphic display board therein.

2. The system as described in claim 1 wherein said wall bracket includes a plurality of parallel index grooves formed therein and along the length of said wall bracket.

3. The system as described in claim 2 further including fastener means such as screws, nails and the like for receipt in said index grooves and therethrough for securing said wall bracket to the wall.

4. The system as described in claim 1 wherein said wall bracket includes a second bracket hanger arm extending outwardly therefrom and a second bracket snap arm extending outwardly therefrom, said second bracket snap arm disposed below said second bracket hanger arm, said system further including a second profile member having a second profile arm for suspending on said second bracket hanger arm and a second profile snap arm for releasable engagement with said second bracket snap arm, said second profile snap arm disposed below said second profile hanger arm.

5. A three dimensional striping system for mounting on a wall and displaying a graphic display board with hanger bracket attached thereto, the system comprising:

a wall bracket having a first bracket hanger arm extending outwardly therefrom and along the length of said wall bracket and a first bracket snap arm extending outwardly therefrom and along the length of said wall bracket, said first bracket snap arm disposed below said second bracket hanger arm, said wall bracket further including a second bracket hanger arm extending outwardly therefrom and a second bracket snap arm extending outwardly therefrom, said second bracket snap arm disposed below said second bracket hanger arm;

a first profile member having a first profile hanger arm extending outwardly therefrom and along the length of said first profile member and a first profile snap arm extending outwardly therefrom and along the length of said first profile member, said first profile snap arm disposed below said first profile hanger arm; and a second profile member having a second profile hanger arm extending outwardly therefrom and along the length of said second profile member and a second profile snap arm extending outwardly therefrom and along the length of said first profile hanger arm, said second profile snap arm disposed below said second profile hanger arm, said first and second profile hanger arms having a top surface with a groove therein and extending downwardly from said top surface, said groove extending along a length of said top surface of said first and second profile hanger arms, said groove adapted for slidable receipt of the hanger bracket of the display graphic board therein, said second profile member disposed parallel to and in a spaced relationship from said first profile member with a portion of said wall bracket disposed therebetween, whereby, when said first and said second profile hanger arms are suspended on said first and said second bracket hanger arms and said first and said second profile snap arms are releasably engaged to said first and said second bracket snap arms, said first and said second profile members are held firmly in place on said wall bracket providing a pleasing three dimensional striping appearance.

6. The system as described in claim 5 wherein said wall bracket includes a plurality of parallel index grooves formed therein and along the length of said wall bracket.

7. The system as described in claim 6 further including fastener means such as screws, nails and the like for receipt in said index grooves and therethrough for securing said wall bracket to the wall.

8. The system as described in claim 7 wherein said index grooves are located on said wall bracket to be hidden behind said first and second profile members when said profile members are mounted on said wall bracket.

9. The system as described in claim 5 wherein said first profile member has a different width than a width of said second profile member for providing a pleasing yet different three dimensional striping appearance.

10. The system as described in claim 5 wherein said first profile member has a different color than a color of said second profile member for providing a pleasing yet different three dimensional, multi-color striping appearance.

11. The system as described in claim 5 wherein said wall bracket has a different color than the colors of said first and second profile members and the color of said exposed portion of said wall bracket between the parallel spacing of said profile members provides a pleasing yet different three dimensional, three color striping appearance.

* * * * *